US006170456B1

(12) United States Patent
Gu et al.

(10) Patent No.: US 6,170,456 B1
(45) Date of Patent: Jan. 9, 2001

(54) LUBRICATING DEVICE FOR FOUR-STROKE ENGINE

(75) Inventors: Huan-Lung Gu, Hualian; Shao-Yu Li; Li-Yu Chen, both of Hsinchu; Chih-Chung Lo, Taoyuan Hsien; Wen-Che Liu, Hsin Chuang, all of (TW)

(73) Assignee: Industrial Technology Research Institute, Hsinchu (TW)

( * ) Notice: Under 35 U.S.C. 154(b), the term of this patent shall be extended for 0 days.

(21) Appl. No.: 09/260,546

(22) Filed: Mar. 2, 1999

(30) Foreign Application Priority Data

Dec. 31, 1998 (TW) ..... 87221914

(51) Int. Cl.[7] ..... F01M 1/00

(52) U.S. Cl. ..... 123/196 S; 123/196 W; 184/6.2

(58) Field of Search ..... 123/196 S, 196 W, 123/195 C, 195 H; 184/6.2, 6.26, 11.1

(56) References Cited

U.S. PATENT DOCUMENTS 3,687,233 * 8/1972 Greenwald ..... 184/6.18
4,270,497 * 6/1981 Valerio ..... 123/195 C
5,176,116 * 1/1993 Imagawa et al. ..... 123/196 W
5,738,062 * 4/1998 Everts ..... 123/195 R
5,860,403 * 1/1999 Hirano et al. ..... 123/196 R
5,960,764 * 10/1999 Araki ..... 123/196 R
5,975,042 * 11/1999 Aizawa et al. ..... 123/196 M

FOREIGN PATENT DOCUMENTS 9-170417 6/1997 (JP) .

OTHER PUBLICATIONS

Conley, et al., "The New Ryobi 26.2 CC, OHV, 4–Stroke Engine For Hand Held Power Equipment Applications", SAE Technical Paper Series 961728, Aug. 26–28, 1996.

* cited by examiner

*Primary Examiner*—Willis R. Wolfe
*Assistant Examiner*—Katrina B. Harris
(74) *Attorney, Agent, or Firm*—Rabin & Champagne, P.C.

(57) ABSTRACT

A lubricating device for four-stroke engine consists of a cylinder block, a crankcase, an oil sump, a piston, a crankshaft, a connecting rod and an oil dipper, the crankcase contains an upper crankcase body and a lower crankcase body, the bottom of the crankcase extends downward to form an oil trough with a hole in it, an oil dipper is able to operate in the oil trough, an oil box is formed for oil containing by the lover crankcase body and the oil sup, when an engine is running on a normal inclination, a shall amount of oil can only get into the oil trough through three hole in it, movement of the oil dipper atomizes the oil to provide lubrication, if the engine is running on an abnormal inclination or bumping condition, oil will not flow into the crankcase, and this design is able to ensure nor-al operation of an engine on any inclinations.

13 Claims, 6 Drawing Sheets

LUBRICATING DEVICE FOR FOUR-STROKE ENGINE

FIELD OF THE INVENTION

The present invention involves a lubricating device for a four-stroke engine, and especially a system that can lubricate an engine running on any inclination.

BACKGROUND OF THE INVENTION

Compared with a two-stroke engine, a four-stroke engine has the advantages of cleaner exhaust and fuel saving. As such, more and more light duty, general industrial/agricultural machines adopt a four-stroke engine according to the Regulation on Environmental Protection. At the present, there are two types of lubricating devices used for a four-stroke engine, i.e., a wet (wet sump) and a dry type. A difference between them is whether or not a common space is used for the crankcase and the oil box.

FIG. 1 shows a design of American RYOBI Co. published in SAE TECHNICAL PAPER SERIES 961728, which is a common wet lubricating device for a four-stroke engine. In this device, a crankcase 11 and an oil box of the four-stroke engine have a common space, i.e., it is a so-called wet sump. This device can be used with certain light duty tools, such as a grass cutter, lopping shears, wood saw and so on. As will be appreciated, these tools are widely used and operated on various inclinations. However, the engine 10 is restricted to operating on no more than a slight inclination to avoid oil flowing out from the oil box. If the engine operates on a larger inclination, oil will flow out from the oil box to the gap between the piston 13 and the cylinder wall and will be pumped into the combustion chamber, resulting in engine failure or oil flowing into the cylinder head and then out from the vent/filter.

In order to allow the engine mentioned above to operate on any inclination, conventional designs also adopt a fully separated oil box, i.e. the oil box and the crankcase are completely separate, to form a so-called dry sump. FIG. 2 shows a design of Japanese Patent of Application No. 7-327665, Application date of Dec. 15, 1995, in which a proper amount of oil is pumped to points to be lubricated in the engine, or oil 22 is splashed by a slinger 21 to create an oil fog which is pumped to the crankcase 23 and the cylinder head 25 for lubrication using suction generated by the piston 24. Although the dry sump has a better structure than the wet sump, an additional oil trough, pressure regulating devices and additional drillings in the crankshaft are needed, resulting in a more complex structure and higher cost.

SUMMARY OF THE INVENTION

A major object of the present invention is to provide a semi-separate crankcase design, in which an oil trough is provided under the crankcase. The oil trough has an internal space just large enough for an oil dipper arm moving in it to create an oil mist for lubrication, so that only a little bit of oil may flow into the crankcase when the engine is inclined.

Another object of the present invention is to arrange a hole in the bottom of the oil trough. The hole forms a path from the oil box to the oil trough, and has a selected diameter that ensures a great amount of oil will not enter the crankcase when the engine is inclined.

A further object of the present object is to provide several plugs, each having an orifice, in the bottom of the crankcase. Therefore, even if the engine is running upside-down, oil will drop into the crankcase and be atomized by the rotating components for lubrication.

In order to describe the objects, characteristics and functions of the present invention, an example of an embodiment accompanied with figures is given as follows:

DETAILED DESCRIPTION OF THE INVENTION

Figure 1:
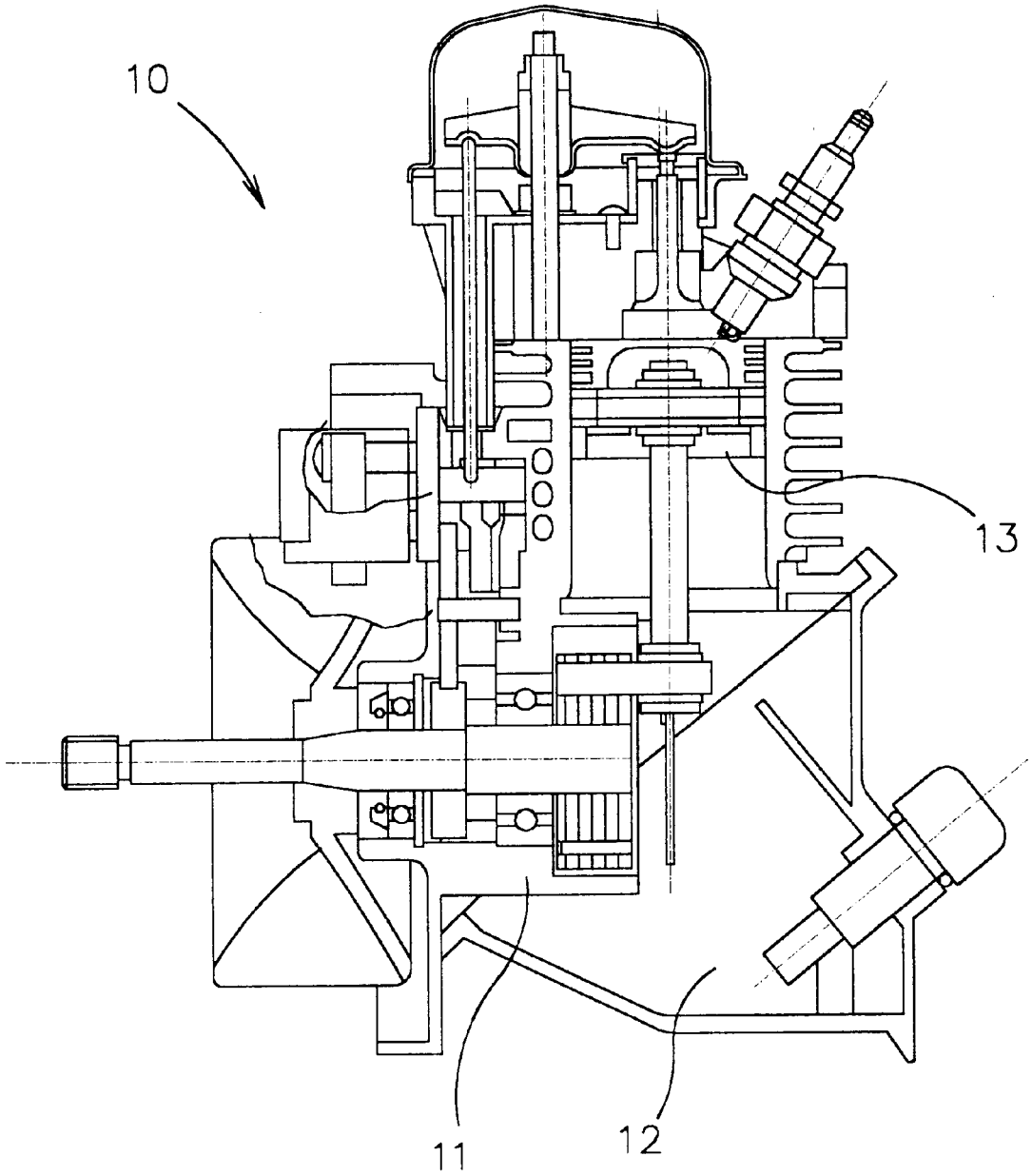
FIG. 1 PRIOR ART
FIG. 1 is a conventional wet type lubricating device for a four-stroke engine.
Figure 2:
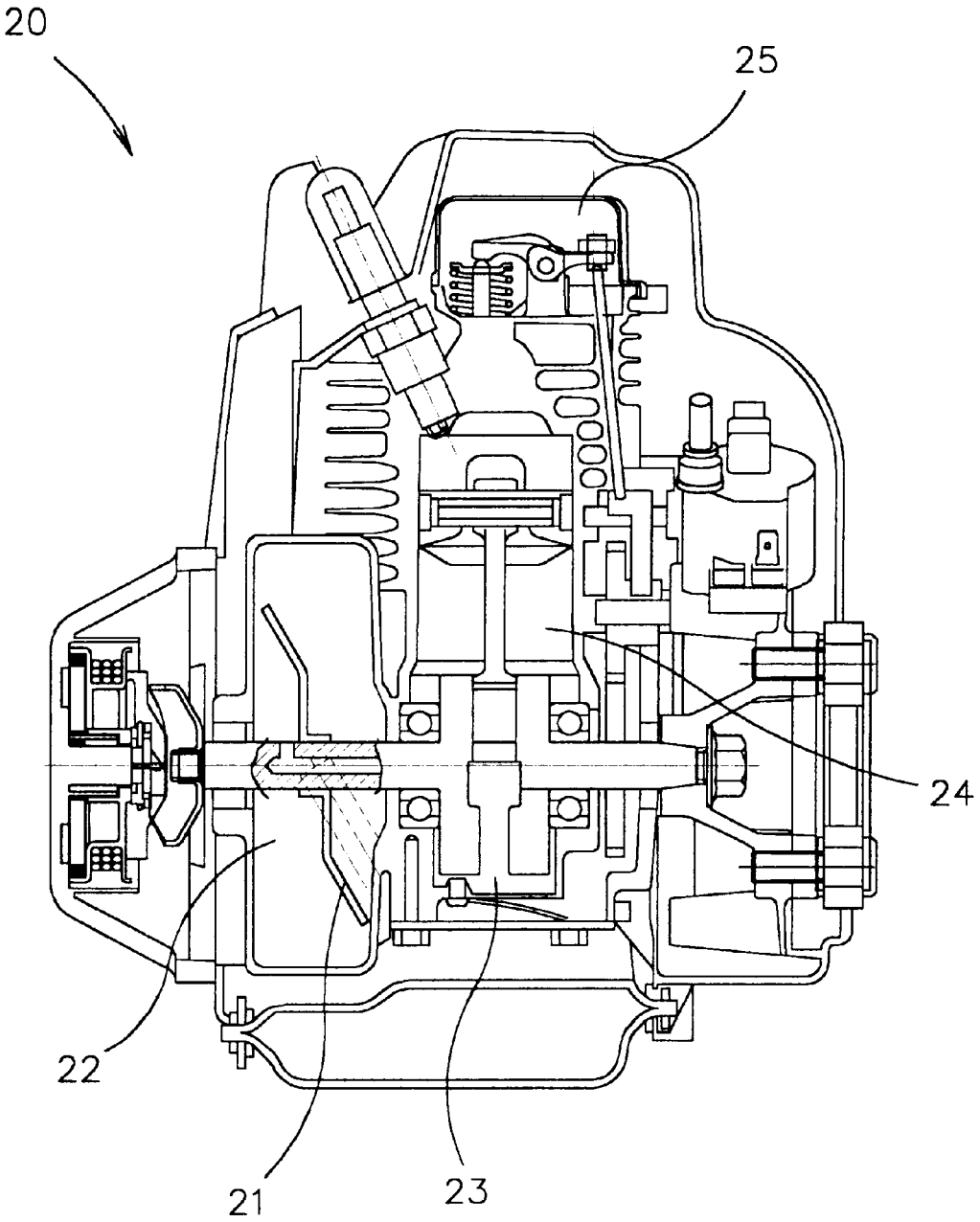
FIG. 2 PRIOR ART
FIG. 2 is a conventional dry type lubricating device for a four-stroke engine.
Figure 3:
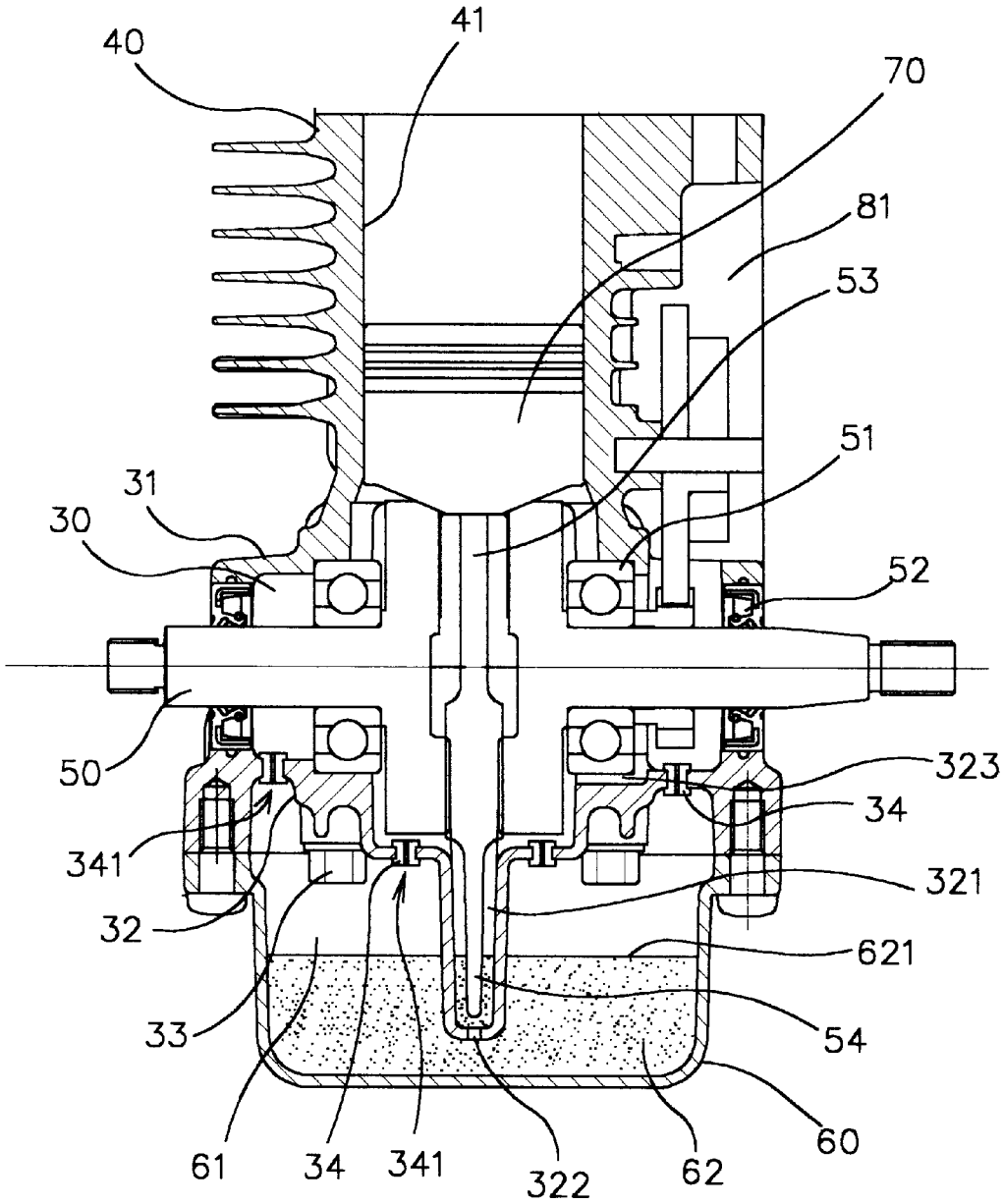
FIG. 3 is a front view of the present invention.

FIG. 3 is a front view of the present invention in which the lubricating device has a semi-separate crankcase. A crankcase 30 of the present invention includes an upper crankcase body 31 and a lower crankcase body 32. The upper crankcase body 31 may be integrated with a cylinder block 40 or manufactured separately. The lower crankcase body 32 matches the upper crankcase body 31, and the two cases 31, 32 are joined together by bolts 33 to form a closed enclosure, i.e., the crankcase 30.

A crankshaft 50 is provided in the crankcase 30. The crankshaft 50 has a bearing 51 and an oil seal 52 arranged at both ends respectively so that the crankshaft 50 is contained in the crankcase 30 and is able to rotate in the crankcase 30. The crankshaft 50 is equipped with a connecting rod 53. An oil dipper 54 is arranged at the lower end of the connecting rod 53. The oil dipper 54 may be bar-shaped and fixed beneath the crankshaft 50, or integrated with the crankshaft and driven by a piston 70. Movement of the piston 70 causes reciprocating motion of the connecting rod 53 and rotation of the crankshaft 50.

The lower crankcase body 32 extends downward at its central part to form an oil trough 321, and a hole 322 is arranged in the bottom of the oil trough at its central point. Further, several through holes are provided adjacent to the oil trough 321. The holes have oil plugs 34 inserted therein.

An oil sump 60 is joined to the bottom of the lower crankcase body 32. A closed enclosure forms an oil box 61 in which oil 62 is contained, between the oil sump 60 and the lower crankcase body 32. The amount of oil 62 shall not exceed one half of the capacity of the oil box. The oil trough 321 formed by the extension of the lower crankcase body 32 extends into the oil box 61 so that part of the oil 62 in the oil box 61 gets into the oil trough 321 through the hole 322, and reaches a same oil level 621 as that of the oil 62 in the oil box 61. The oil trough 321 provides a very small space which is just large enough for the moving of the oil dipper 54 therein. Therefore, the volume of oil 62 kept in the oil trough 321 will not be large.

Figure 4:
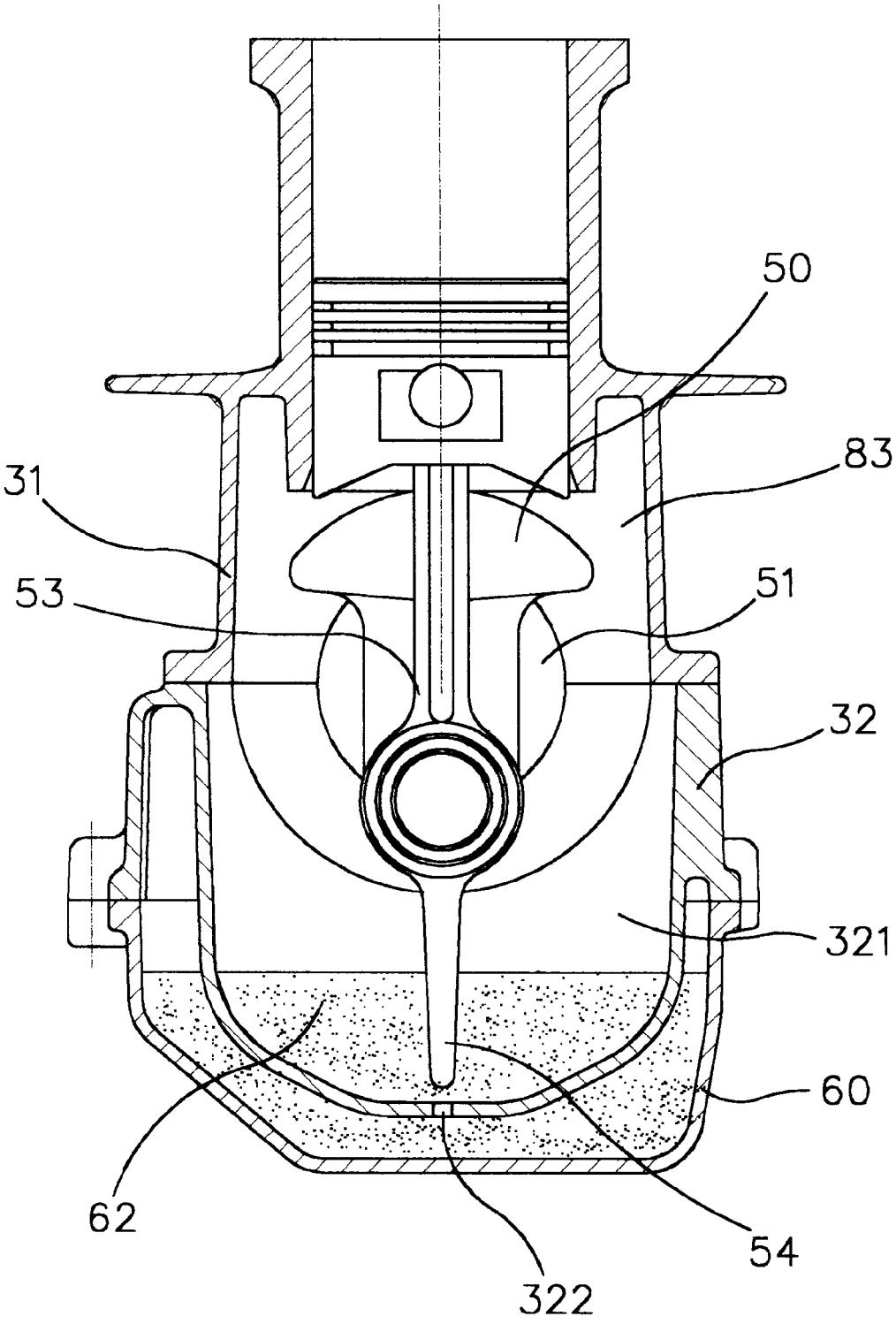
FIG. 4 is a side view of the present invention.

Referring to FIG. 4, when the crankshaft 50 rotates, the oil dipper 54 will enter the oil trough 321 and stir up the oil 62 continually. Since the crankshaft 50 and the connecting rod 53 are moving at a high speed, the oil stirred up by the oil dipper 54 will be atomized to create oil mist which will spread inside the engine and adhere everywhere inside of the crankcase 30, thus providing lubrication between the piston 70 and the cylinder block 40, between the piston 70 and the connecting rod 53, between the connecting rod 53 and the crankshaft 50, and lubricating bearings 51.

When the piston 70 moves up and down, air in the crankcase 30 flows like 'respiration' so that oil mist is able to get into a space 81 (FIG. 3) to the cylinder head (not shown in the figure), through the gap in bearing 51, and oil routes 323 in the lower crankcase body 32. Thus, all points which need to be lubricated inside the engine will be lubricated with oil, and the oil seals 52 can prevent the oil mist and oil from escaping out of the engine.

Figure 5:
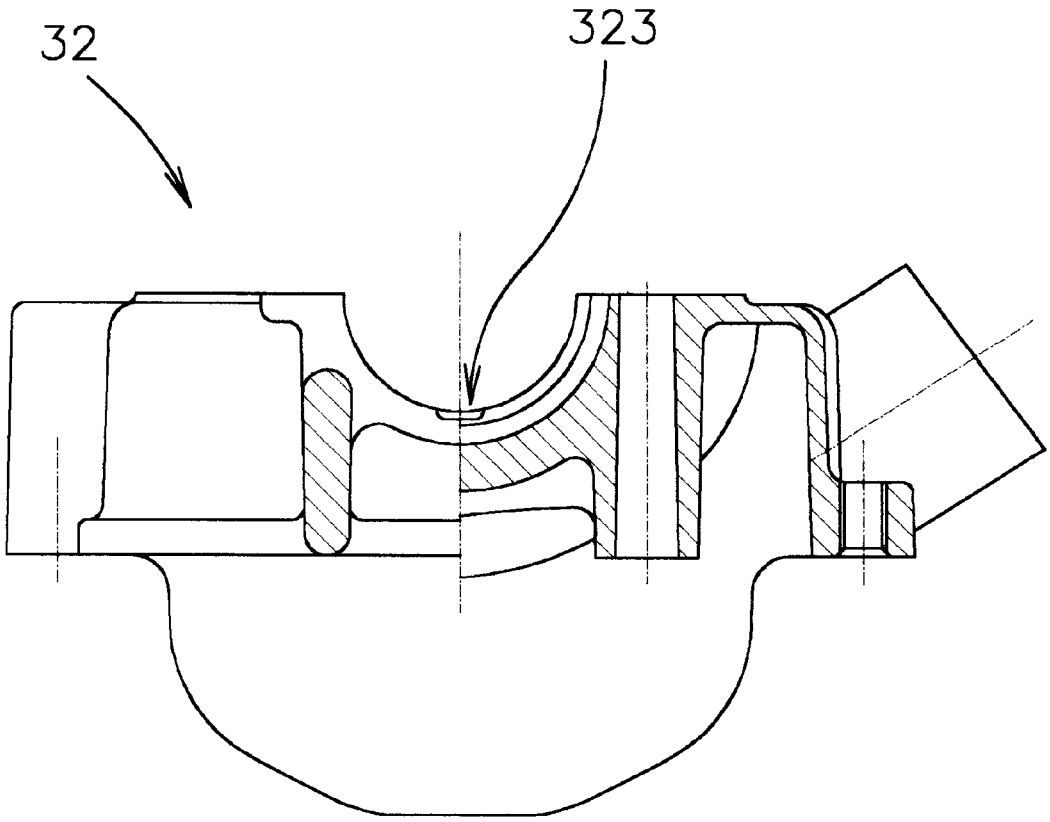
FIG. 5 is a schematic sectional view of oil routes in a lower crankcase body of the present invention.

FIG. 5 is a schematic sectional view of the oil routes in a lower crankcase body of the present invention.

Figure 6:
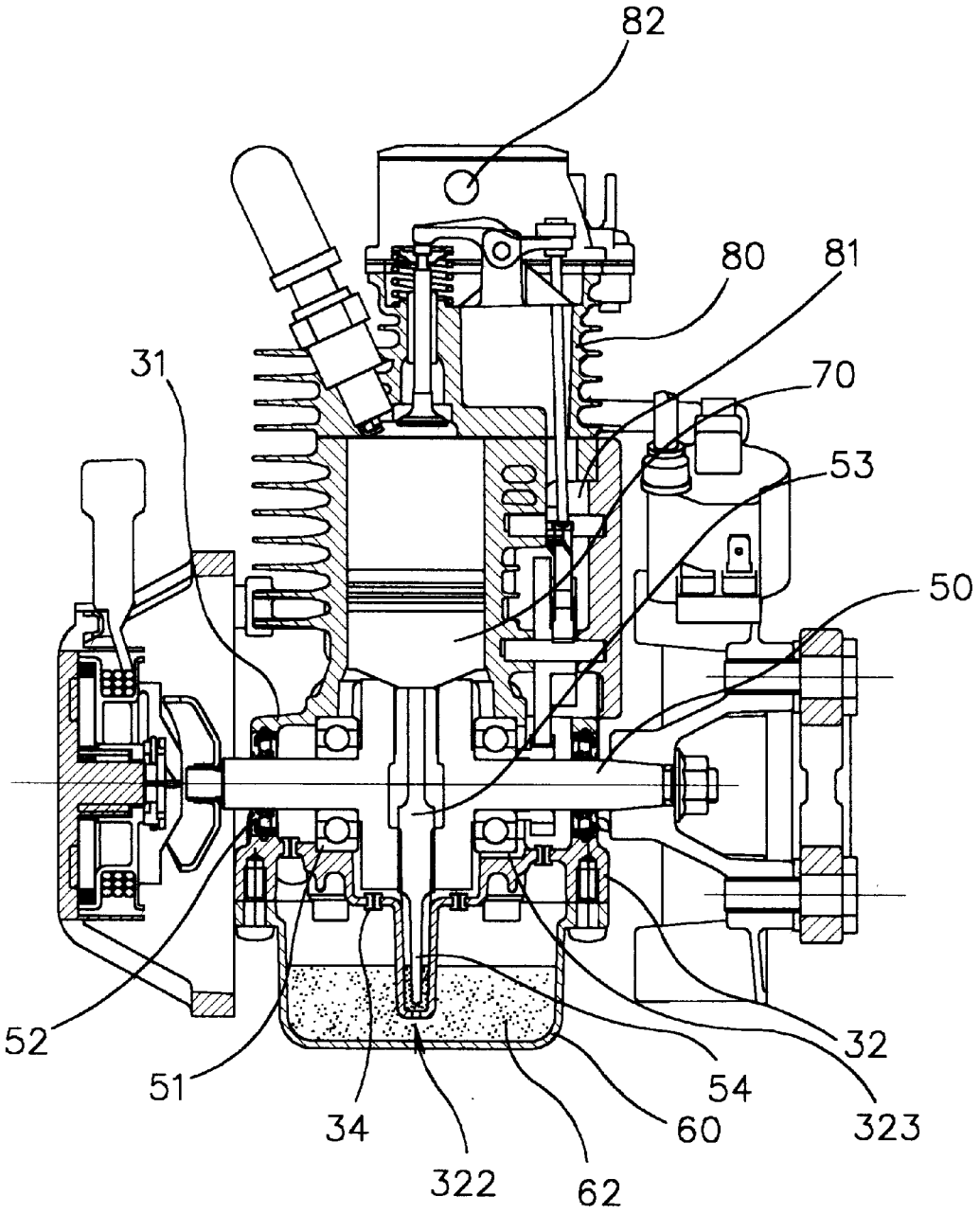
FIG. 6 is an embodiment of the present invention utilized with a four-stroke engine.

Referring to FIG. 6, oil mist which enters the cylinder head 80 is filtered by a breather filter 82 and will be condensed as oil drops. The oil drops will flow into the oil trough 321 through the space 81 and the oil routes 323, or return to the oil box 61 through the oil plugs 34.

When the engine is running on a normal condition or slight inclination, of course, lubrication will not be affected. However, when a large inclination occurs in any directions, due to the hole 322 provided at the central point of the oil trough 321, the oil volume in the oil box 61 will be controlled to a certain value so that the oil level will always be lower than the position of the hole 322. If the engine is inclined in any direction by 90 degrees or more, a large amount of oil will not get into the crankcase 30. At most, only the oil remaining in the oil trough may get into the crankcase 30. If the engine is inclined in any direction by more than 150 degrees or even by 180 degrees, the oil in the crankcase 30 will flow into the recess 83 rather than into the gap between the piston 70 and the cylinder wall 41.

FIG. 6 is an exemplary embodiment of the present invention, in which the oil plugs 34 may be made from a rubber or spongy type material. When a rubber material is used, an orifice 341 is provided so that oil 62 may pass through the orifice 341 in the oil plug 34. If oil plugs of a foam rubber material are used, oil 62 will drop down from the plugs using capillary action.

When the engine is running on a large inclination for a long time, oil 62 will fail to get into the oil trough 321 through the hole 322 and the oil dipper 54 will be running idle. In that case, oil 62 will drop onto rotating components from the orifices 341 in the oil plugs 34. The oil drops will be atomized by the high speed rotating components to ensure lubrication in the engine.

The embodiment mentioned above is only an exemplary example of the present invention and does not restrict the present invention in any manner. Any modification or change made based on the present invention shall be considered to be within the coverage of the present invention.

What is claimed is:

1. A lubricating device for a four-stroke engine, comprising:

a crankcase which includes an upper crankcase body, and a lower crankcase body in which a plurality of first through holes are provided, said lower crankcase body further having an extension that forms a trough, the extension having a second through hole in a bottom thereof in fluid communication with the trough;

a plurality of oil plugs, each oil plug being inserted within a respective first through hole, and allowing the limited passage of oil;

an enclosed oil box disposed below the crankcase, said extension projecting into the oil box, so that when the four-stroke engine is level, the second through hole is below a level of the oil within the oil box so that the oil within the oil box will flow into the trough via the second through hole;

a crankshaft which is disposed in the crankcase; and an oil dipper connected with the crankshaft, and projecting into the trough, so that oil within the trough is stirred and atomized by the oil dipper when the crankshaft is rotated.

2. The lubricating device according to claim 1, wherein the upper crankcase body is bolted to the lower crankcase body.

3. The lubricating device according to claim 1, wherein the upper crankcase body and the lower crankcase body form an integral unitary body.

4. The lubricating device according to claim 1, wherein the lower crankcase body covers bearings and oil seals.

5. The lubricating device according to claim 1, wherein the upper crankcase body and a cylinder block form an integral unitary body.

6. The lubricating device according to claim 1, wherein the upper crankcase body and a cylinder block are two separate bodies.

7. The lubricating device according to claim 1, wherein the oil plugs are comprised of one of a rubber and a spongy type material.

8. The lubricating device according to claim 1, wherein the oil dipper is connected to a counterweight of the crankshaft.

9. The lubricating device according to claim 1, wherein the oil dipper and the crankshaft form an integral unitary body.

10. The lubricating device according to claim 1, wherein the oil dipper is bar-shaped and fixed onto a lower point of the crank.

11. The lubricating device according to claim 1, further comprising a connecting rod connected to the crankshaft, wherein the oil dipper is connected to a lower portion of said connecting rod.

12. The lubricating device according to claim 1, wherein when the four-stroke engine is operated at an inclination, the oil plugs allow a limited amount of oil to pass therethrough into the crankcase, where the limited amount of oil is atomized by rotating components.

13. The lubricating device according to claim 1, wherein when the four-stroke engine is at an inclination, the second through hole is disposed above a level of the oil within the oil box.

* * * * *